US006134723A

United States Patent [19]

Benson

[11] Patent Number: 6,134,723

[45] Date of Patent: Oct. 24, 2000

[54] BATHTUB SEAT

[76] Inventor: Walter J. Benson, 8201 NW. 8 Pl., Plantation, Fla. 33324

[21] Appl. No.: 09/233,277

[22] Filed: Jan. 19, 1999

[51] Int. Cl.[7] ..... A47K 3/12; A47K 3/022

[52] U.S. Cl. ..... 4/579; 4/578.1; 4/609

[58] Field of Search ..... 4/579, 578.1, 559, 4/608, 609, 610

[56] References Cited

U.S. PATENT DOCUMENTS

| | | | |
|---|---|---|---|
| 1,597,922 | 8/1926 | Osborn | 4/579 |
| 1,739,163 | 12/1929 | Mitchell | 4/579 |
| 4,279,396 | 7/1981 | Bendock | 248/205.5 |
| 5,412,817 | 5/1995 | Smith | 4/578.1 |

FOREIGN PATENT DOCUMENTS

| | | | |
|---|---|---|---|
| 1600875 | 10/1981 | United Kingdom | 4/579 |

*Primary Examiner*—Henry J. Recla
*Assistant Examiner*—Tuan Nguyen
*Attorney, Agent, or Firm*—Frank L. Kubler

[57] ABSTRACT

A bathtub seat for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, the bathtub seat including a support panel for extending across the bathtub and resting on opposing the side rim segments, the support panel having a panel forward end and a panel rearward end. The seat preferably additionally includes an engaging lip extending downwardly from the support panel and into the tub in close proximity to opposing segments of the bathtub side wall for abutting the bathtub wall and thereby preventing substantial lateral movement of the support panel relative to the bathtub. The engaging lip preferably extends downwardly only from the panel forward end. The engaging lip preferably curves inwardly in the downward direction, to correspond to and follow the contours of the bathtub side wall rim segments and interior tub wall surfaces for firmly securing the seat against lateral movement.

18 Claims, 2 Drawing Sheets

BATHTUB SEAT

BACKGROUND OF THE INVENTION

1. Field of the Invention

The present invention relates generally to the field of bathroom facilities and items. More specifically the present invention relates to a seat which removably fits across the upper rim of a conventional bathtub so that a user can sit on the seat at one end of the tub while dangling his or her feet in the tub directly below the user.

The seat preferably includes a support panel for extending across the width of a conventional bathtub and resting on the tub rim at the tub wall upper ends. A tub engaging lip extends downwardly from the support panel forward end, curving inwardly to correspond to and abut the contours of the tub rim and interior tub wall surfaces to secure the seat against lateral movement relative to the tub. The support panel and engaging lip are preferably molded as a single, continuous piece of plastic in the form of a thin wall defining in broad terms a downwardly opening cup. The support panel preferably has posterior receiving shallow recesses of a shape commonly found in hard surface seats. A shower curtain engaging perimeter wall is optionally provided which releasably engages the upper surface of the panel along the panel side and rearward perimeter edges. The perimeter wall preferably takes the form of a planar rear wall of continuous height and two side walls of forwardly diminishing height, the side walls and optionally the rear wall including inwardly extending curtain engaging fasteners. Periodically positioned dowels preferably extend downwardly from the perimeter wall lower surfaces and fit into correspondingly located dowel ports along the panel upper surface perimeter. The curtain engaging fasteners are preferably S-shaped spring plates secured at one end to a planar mounting plate having an adhesive backing for securing to the interior side surfaces of the perimeter wall. The curtain fits snugly under the resilient free end of the S-shaped spring plate, which optionally includes an inwardly protruding engaging bulb.

2. Description of the Prior Art

There have long been vessels designed for retaining water and receiving the feet of a user as the user sits in a chair, for medical and comfort reasons. The DAZEY FOOT SAVER™ foot massager is one example of this. A problem with these prior devices has been that the water is often splashed and spilled onto the surrounding floor, damaging carpets and in some instances warping the floor.

It is thus an object of the present invention to provide a bathtub seat which permits the user to sit safely and comfortably over water in the bathtub and immerse his or her feet in the water.

It is another object of the present invention to provide such a bathtub seat which can be quickly installed and removed from the bathtub without need of tools, and which does not mar the bathtub surface.

It is still another object of the present invention to provide such a bathtub seat which optionally can engage and hold in place a shower curtain.

It is finally an object of the present invention to provide such a bathtub seat which is highly economical to manufacture.

SUMMARY OF THE INVENTION

The present invention accomplishes the above-stated objectives, as well as others, as may be determined by a fair reading and interpretation of the entire specification.

A bathtub seat is provided for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, the bathtub seat including a support panel for extending across the bathtub and resting on opposing the side rim segments, the support panel having a panel forward end and a panel rearward end.

The seat preferably additionally includes an engaging lip extending downwardly from the support panel and into the tub in close proximity to opposing segments of the bathtub side wall for abutting the bathtub wall and thereby preventing substantial lateral movement of the support panel relative to the bathtub. The engaging lip preferably extends downwardly only from the panel forward end. The engaging lip preferably curves inwardly in the downward direction, to correspond to and follow the contours of the bathtub side wall rim segments and interior tub wall surfaces for firmly securing the seat against lateral movement. The support panel and the engaging lip are optionally molded as a single, continuous piece of material.

The support panel and the engaging lip optionally are molded sheet material and define generally a downwardly opening cup. The support panel optionally has a user posterior receiving recess.

The seat optionally additionally includes a shower curtain engaging perimeter wall having structure for engaging the support panel perimeter wall including shower curtain fastening elements. The perimeter wall structure for engaging engage the support panel preferably engages the support panel releasibly. The perimeter wall preferably includes a perimeter rear wall segment for extending along the rearward end of the support panel and two substantially parallel and spaced apart perimeter side wall segments. The perimeter wall has an outer surface and the curtain fastening elements preferably include inwardly extending curtain engaging fasteners secured to the outer surface of the perimeter wall. The perimeter wall preferably includes several downwardly extending dowels and the support panel upper surface preferably includes correspondingly positioned dowel ports for receiving the dowels and thereby releasibly interconnecting the perimeter wall and the support panel.

The curtain engaging fasteners are preferably resilient clips which receive and hold with friction an edge of a shower curtain. More specifically, the curtain engaging fasteners are preferably S-shaped resilient spring plates each having a connecting end and a free end, secured at the connecting end to a planar mounting plate having an adhesive backing for securing to the inner surfaces of the perimeter wall, so that the shower curtain fits snugly under the resiliently biased free end of the S-shaped spring plate.

A bathtub and bathtub seat combination is further provided, including a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, and a bathtub seat including a support panel extending across the bathtub and resting on opposing side rim segments, the support panel having a panel forward end and a panel rearward end.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
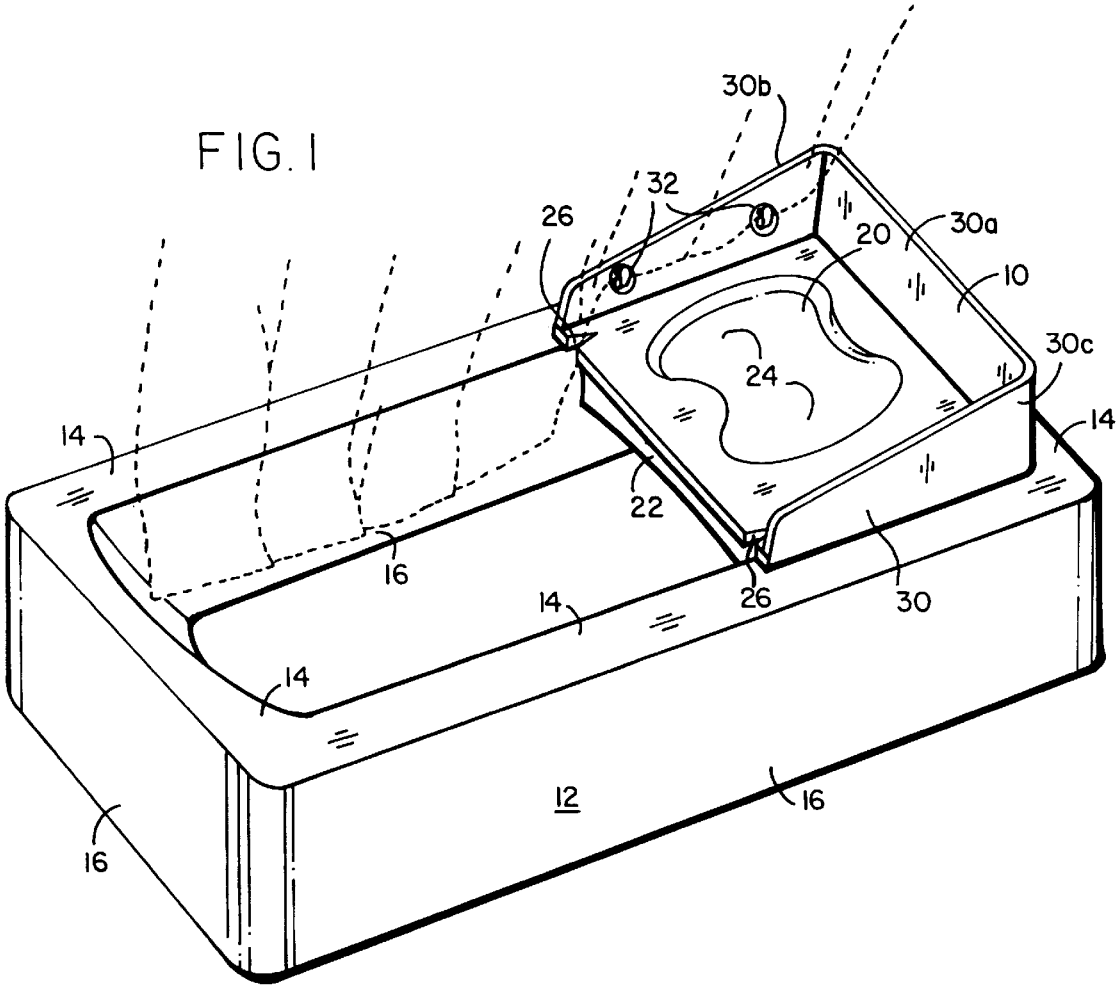
FIG. 1 is a perspective view of the preferred embodiment of the bathtub seat, fitted with the optional perimeter wall, showing how the slots and fasteners engage a shower curtain.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
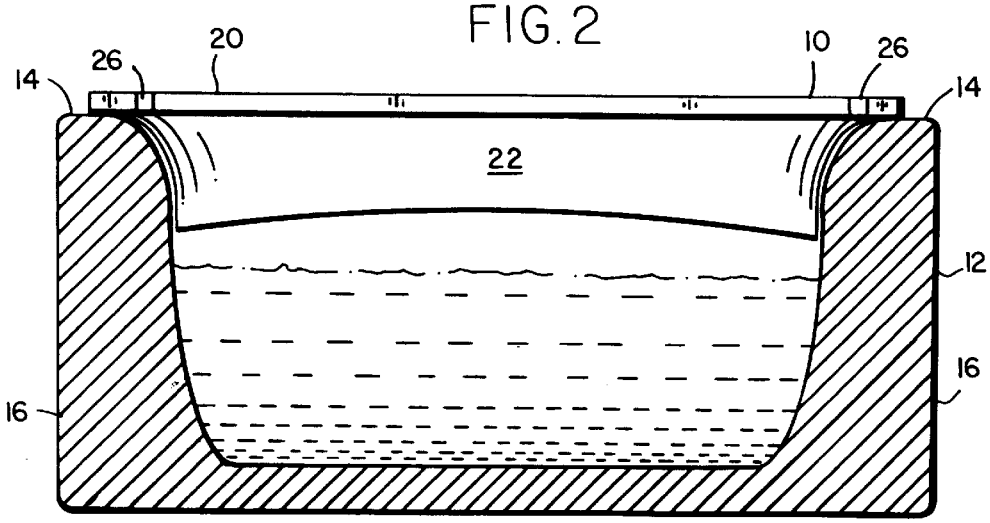
FIG. 2 is a cross-sectional view of a bathtub with the seat fitted into place, showing how the shape of the engaging lip fits the contours of the bathtub walls.
Figure 3:
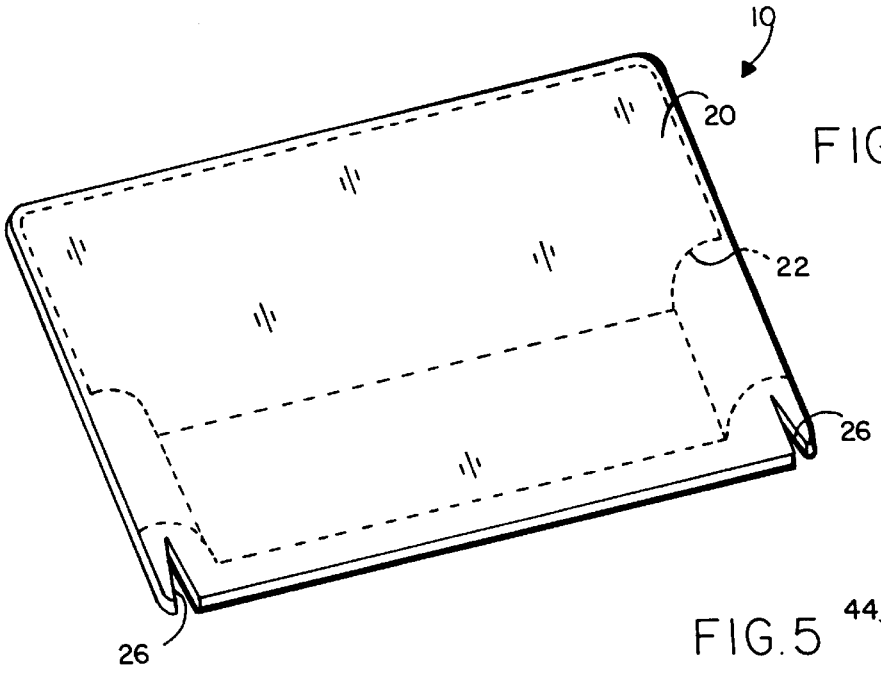
FIG. 3 is a perspective view of the seat only, showing the shower curtain engaging slots. This FIGURE shows the preferred construction in which the tub engaging lip extends below only the forward half or third of the support panel.
Figure 5:
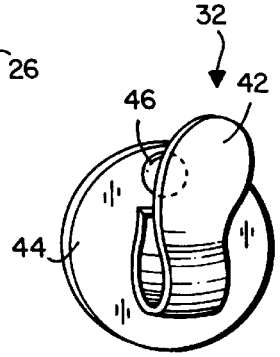
FIG. 5 is a perspective view of the preferred shower curtain fastener.
Figure 4:
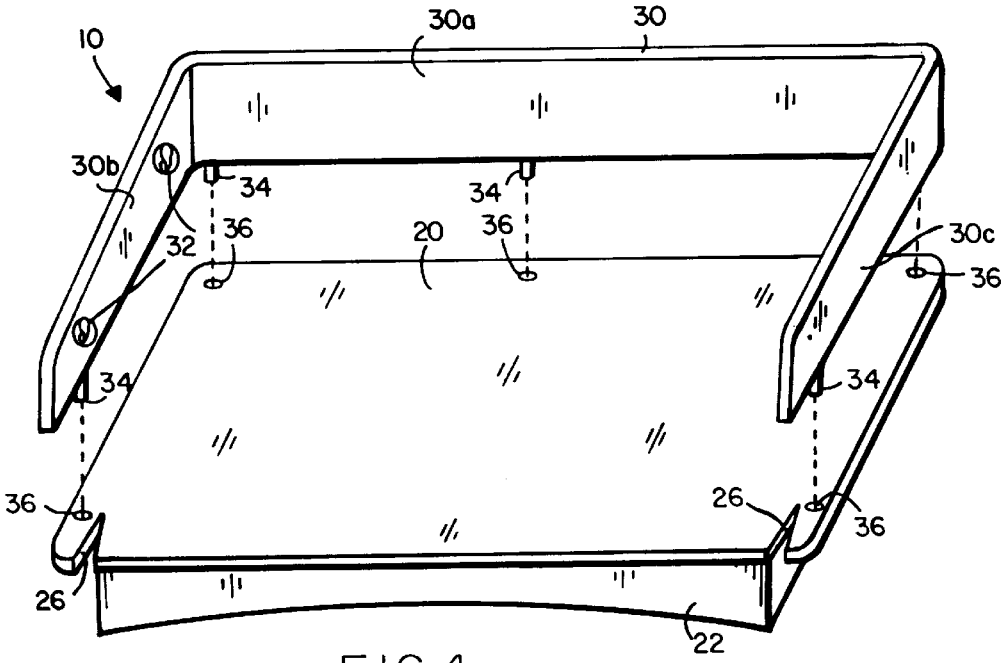
FIG. 4 is a perspective view of the bathtub seat of FIG. 1 with the perimeter wall separated, showing the interlocking dowls and ports for connecting the perimeter wall.

Referring to FIGS. 1–5, a bathtub seat 10 is disclosed. Seat 10 removably fits across the upper rim 14 of a bathtub 12 so that a user can sit on the seat 10 at one end of the bathtub 12 while dangling his or her feet into water in the bathtub 12 directly below the user.

Seat 10 preferably includes a support panel 20 for extending across the width of a conventional bathtub 12 and resting on the tub rim 14 at the tub wall 16 upper ends. A tub engaging lip 22 extends downwardly from the support panel 20 forward end, curving inwardly to correspond to and abut the contours of the tub rim 14 and interior tub wall 16 surfaces to secure the seat 10 against lateral movement relative to the bathtub 12. See FIG. 2. Engaging lip 22 is preferably set back two or three inches from the support panel 20 forward end, so that the user legs are free to swing back without striking it. Shower curtain receiving and engaging slots 26 are preferably provided in opposing sides of the support panel 20 forward end.

Support panel 20 and engaging lip 22 are preferably molded as a single, continuous piece of plastic in the form of a thin wall defining in broad terms a downwardly opening cup. Support panel 20 preferably has posterior receiving shallow recesses 24 of a shape commonly found on hard surface seats.

A shower curtain engaging perimeter wall 30 is optionally provided which releasably engages the upper surface of support panel 22 along the panel 20 side and rearward perimeter edges. Perimeter wall 30 preferably takes the form of a planar rear wall 30*a* of continuous height and two side walls 30*b* and 30*c* of forwardly diminishing height, the side walls 30*b* and 30*c*, and optionally the rear wall 30*a*, include outwardly extending shower curtain engaging fasteners 32. See FIG. 1. Periodically positioned dowels 34 preferably extend downwardly from perimeter wall 30 lower surfaces and fit into correspondingly located dowel ports 36 along the support panel 20 upper surface perimeter. See FIG. 4.

Shower curtain engaging fasteners 32 are preferably S-shaped spring plates 42 secured at one end to a planar mounting plate 44 having an adhesive backing for securing to the side surfaces of perimeter wall 30. See FIG. 5. The shower curtain (not shown) fits snugly under the resilient free end of the S-shaped spring plate 42, which optionally includes an inwardly protruding engaging bulb 46.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A bathtub and bathtub seat combination, comprising:

a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, a bathtub seat comprising a support panel extending across said bathtub and resting on opposing said side rim segments, said support panel having a panel forward end and a panel rearward end;

a shower curtain engaging perimeter wall having a perimeter wall inward surface and a perimeter wall outward surface, and having means for engaging said support panel;

shower curtain fastening means positioned to secure a shower curtain along said perimeter wall adjacent to said perimeter wall inward surface;

shower curtain receiving means in said support panel for receiving a portion of said shower curtain;

and a shower curtain extending over said perimeter wall inward surface and fastened to said perimeter wall with said shower curtain fastening means, wherein a portion of said shower curtain passes within said shower curtain receiving means.

2. The seat of claim 1, additionally comprising an engaging lip extending downwardly from said support panel and into the tub in close proximity to opposing segments of the bathtub side wall for abutting the bathtub wall and thereby preventing substantial lateral movement of said support panel relative to said bathtub.

3. The seat of claim 2, wherein said engaging lip extends downwardly only from said panel forward end.

4. The seat of claim 2, wherein said engaging lip curves inwardly in the downward direction, to correspond to and follow the contours of said bathtub side wall rim segments and interior tub wall surfaces for firmly securing said seat against lateral movement.

5. A bathtub seat for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, said bathtub seat comprising:

a support panel for extending across the bathtub and resting on opposing said side rim segments, said support panel having a panel forward end and a panel rearward end;

a shower curtain engaging perimeter wall having a perimeter wall inward surface and a perimeter wall outward surface, and having means for engaging said support panel;

shower curtain fastening means positioned to secure a shower curtain along said perimeter wall adjacent to said perimeter wall inward surface;

and a shower curtain engaging slot in said support panel substantially adjacent to said perimeter wall, for receiving a portion of a shower curtain to retain the shower curtain against said perimeter wall inward surface.

6. A bathtub seat and shower curtain apparatus for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, said bathtub seat comprising:

a support panel for extending across the bathtub and resting on opposing said side rim segments, said support panel having a panel forward end and a panel rearward end;

a shower curtain engaging perimeter wall having a perimeter wall inward surface and a perimeter wall outward surface, and having means for engaging said support panel;

shower curtain fastening means positioned to secure a shower curtain along said perimeter wall adjacent to said perimeter wall inward surface;

shower curtain receiving means in said support panel for receiving a portion of said shower curtain;

and a shower curtain extending over said perimeter wall inward surface and fastened to said perimeter wall with said shower curtain fastening means, wherein a portion of said shower curtain passes within said shower curtain receiving means.

7. The seat of claim 5, additionally comprising an engaging lip extending downwardly from said support panel and into the tub in close proximity to opposing segments of the bathtub side wall for abutting the bathtub wall and thereby preventing substantial lateral movement of said support panel relative to said bathtub.

8. The seat of claim 7, wherein said engaging lip extends downwardly only from said panel forward end.

9. The seat of claim 7, wherein said engaging lip curves inwardly in the downward direction, to correspond to and follow the contours of said bathtub side wall rim segments and interior tub wall surfaces for firmly securing said seat against lateral movement.

10. The seat of claim 7, wherein said support panel and said engaging lip are molded as a single, continuous piece of material.

11. The seat of claim 10, wherein said support panel and said engaging lip are molded sheet material and define generally an inverted cup, such that the rim and opening of said cup are generally directed downwardly.

12. The seat of claim 5, wherein said support panel has a user posterior receiving recess.

13. The seat of claim 5, additionally comprising a shower curtain engaging perimeter wall having means for engaging said support and comprising shower curtain fastening means;

wherein said perimeter wall means for engaging said support panel releasibly.

14. The seat of claim 5, wherein said perimeter wall comprises a perimeter rear wall segment for extending along said rearward end of said support panel and two substantially parallel and spaced apart perimeter side wall segments.

15. The seat of claim 5, wherein said perimeter wall has an outer surface and wherein said curtain fastening means comprise inwardly extending curtain engaging fasteners secured to the inward surface of said perimeter wall.

16. A bathtub seat for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, said bathtub seat comprising:

a support panel for extending across the bathtub and resting on opposing said side rim segments, said support panel having a panel forward end and a panel rearward end;

a shower curtain engaging perimeter wall having means for engaging said support panel and comprising shower curtain fastening means;

wherein said perimeter wall comprises a plurality of downwardly extending dowels and wherein said support panel upper surface comprises correspondingly positioned dowel ports for receiving said dowels and thereby releasibly interconnecting said perimeter wall and said support panel.

17. The seat of claim 15, wherein said curtain engaging fasteners are resilient clips which receive and hold with friction an edge of a shower curtain.

18. A bathtub seat for use with a bathtub having a bathtub bottom wall and a bathtub side wall, the bathtub side wall being sealingly connected to the bathtub bottom wall and forming a continuous loop for retaining water and having a side wall rim at the bathtub side wall upper end, the bathtub side wall defining opposing side wall rim segments and bathtub ends, said bathtub seat comprising:

a support panel for extending across the bathtub and resting on opposing said side rim segments, said support panel having a panel forward end and a panel rearward end;

a shower curtain engaging perimeter wall having means for engaging said support panel and comprising shower curtain fastening means;

wherein said perimeter wall has an outward surface and has an inward surface and wherein said curtain fastening means comprise inwardly extending curtain engaging fasteners secured to the inward surface of said perimeter wall;

wherein said curtain engaging fasteners are S-shaped resilient spring plates, each said plate having a connecting end and a free end and being secured at the connecting end to a planar mounting plate having an adhesive backing for securing to said inward surface of said perimeter wall, such that the shower curtain fits snugly under the resiliently biased free end of the S-shaped spring plate.

* * * * *